US009050834B2

(12) United States Patent
Hoshi

(10) Patent No.: US 9,050,834 B2
(45) Date of Patent: Jun. 9, 2015

(54) THERMAL PRINTER

(71) Applicant: SATO HOLDINGS KABUSHIKI KAISHA, Tokyo (JP)

(72) Inventor: Kazuyuki Hoshi, Tokyo (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 0 days.

(21) Appl. No.: 14/381,941

(22) PCT Filed: Feb. 25, 2013

(86) PCT No.: PCT/JP2013/054741

§ 371 (c)(1),
(2) Date: Aug. 28, 2014

(87) PCT Pub. No.: WO2013/129305

PCT Pub. Date: Sep. 6, 2013

(65) Prior Publication Data

US 2015/0035933 A1 Feb. 5, 2015

(30) Foreign Application Priority Data

Mar. 1, 2012 (JP) ..... 2012-045155

(51) Int. Cl.
*B41J 11/00* (2006.01)

(52) U.S. Cl.
CPC ..... *B41J 11/0045* (2013.01)

(58) Field of Classification Search
USPC ..... 347/16, 171, 197, 198, 213–215, 347/217–219, 222; 400/611, 613, 618, 621, 400/621.1
See application file for complete search history.

(56) References Cited

U.S. PATENT DOCUMENTS

| | | | | |
|---|---|---|---|---|
| 5,019,839 | A * | 5/1991 | Watanabe et al. | 347/218 |
| 5,618,117 | A * | 4/1997 | Yoshida et al. | 347/218 |
| 2004/0119807 | A1 * | 6/2004 | Fujiwara | 347/218 |
| 2013/0278702 | A1 * | 10/2013 | Ishii et al. | 347/218 |
| 2014/0210937 | A1 * | 7/2014 | Nomura | 347/218 |

FOREIGN PATENT DOCUMENTS

| | | |
|---|---|---|
| JP | 3-293177 | 12/1991 |
| JP | 4-112063 | 4/1992 |
| JP | 11-43247 | 2/1999 |
| JP | 2010-184360 | 8/2010 |

OTHER PUBLICATIONS

International Search Report dated Mar. 19, 2013 issued in corresponding International patent application No. PCT/JP2013/054741.

* cited by examiner

*Primary Examiner* — Kristal Feggins
(74) *Attorney, Agent, or Firm* — Ostrolenk Faber LLP

(57) ABSTRACT

A thermal printer configured for preventing fluttering of a sheet during its printing by a thermal head for preventing printing failure or a sheet jam. A thermal head (26) opposes a platen roller (28). A scale (60) is provided in a fixed guide portion (23) which is provided on an upstream side of the platen roller (28) and guides an entire width of a sheet (12). A pair of sheet width guides (18*a*) and (18*b*) on an upstream side of the fixed guide portion (23) guide a sheet width. Upper guide plates (20*a*) and (20*b*) provided in the sheet guides (18*a*) and (18*b*) are shaped and located to reach an upper portion of the fixed guide portion (23).

4 Claims, 3 Drawing Sheets

THERMAL PRINTER

CROSS-REFERENCE TO RELATED APPLICATIONS

The present application is a 35 U.S.C. §§371 National Phase conversion of PCT/JP2013/054741, filed Feb. 25, 2013, which claims priority of Japanese Patent Application No. 2012-045155, filed Mar. 1, 2012, the contents of which are incorporated by reference herein. The PCT International Application was published in the Japanese language.

TECHNICAL FIELD

The present invention relates to a thermal printer which performs printing on a sheet using a thermal head, and more particularly to a thermal printer provided with sheet guides.

BACKGROUND ART

Hitherto, there is a thermal printer which performs printing using a thermal head. The thermal head is a so-called line thermal head in which a number of heating elements are formed on a substrate to be arranged in a row, and is provided so that the arrangement direction of the heating elements is perpendicular to a sheet transport direction.

A platen roller is disposed to oppose the thermal head, and the thermal head is biased against and comes into pressure contact with the platen roller. A sheet transport path on which sheets are transported is formed between the thermal head and the platen roller.

The sheet is transported as the platen roller rotates while being guided by a guide plate and is printed by the thermal head. For example, Patent Literature 1 discloses that a sheet is guided by a guide inclination plate, a pair of width restriction plates, and a printing surface pressing plate provided in the width restriction plate.

CITATION LIST

Patent Literature

Patent Literature 1: JP 11-43247 A

SUMMARY OF INVENTION

Technical Problem

However, when the sheet is guided and transported to the thermal head as in the Patent Literature 1, there is a problem in that the sheet flutters, which becomes the causes of printing failure and a sheet jam.

The invention has been made taking the forgoing circumstances into consideration, and an object thereof is to provide a thermal printer capable of preventing printing failure or a sheet jam.

Solution to Problem

According to the invention, a thermal printer includes: a platen roller which is rotatable; a thermal head which is disposed to oppose the platen roller; a fixed guide portion which is provided on an upstream side of the platen roller and guides a lower side of an entire width of a sheet; and a pair of sheet guides which is provided on an upstream side of the fixed guide portion, is constituted by a width guide plate that guides a sheet width, a lower guide plate that guides the lower side of the sheet, and an upper guide plate that guides an upper side of the sheet, and is movable in a sheet width direction, wherein the upper guide plate is formed to reach an upper portion of the fixed guide portion.

According to the invention, since the sheet is transported to the platen roller by the fixed guide portion that is provided on the upstream side of the platen roller and guides the lower side of the entire width of the sheet and the upper guide plate that guides the upper side of the sheet and is formed to reach the upper portion of the fixed guide portion, fluttering of the sheet during printing by the thermal head can be prevented, and thus printing failure or a sheet jam can be prevented.

Furthermore, in the invention, since the upper guide plate is formed to reach the upper portion of the fixed guide portion to which a scale for checking the sheet width is attached, the sheet width can be easily set, and the setting of the sheet width can be accurately performed. Since the setting of the sheet width can be accurately performed, fluttering of the sheet can be prevented.

In the invention, it is preferable that the upper guide plate be formed to reach a position of a leading edge of the fixed guide portion. Fluttering of the sheet can thereby be further prevented, and thus printing failure or a sheet jam can be prevented. In addition, the scale for checking the sheet width is easily checked.

In the invention, it is preferable that a leading edge portion of the upper guide plate on the platen roller side have an R shape. The sheet can therefore be transported to the platen roller without damaging the printing surface of the sheet.

Advantageous Effects of Invention

According to the thermal printer according to the invention, it is possible to provide the thermal printer capable of preventing printing failure or a sheet jam.

DESCRIPTION OF EMBODIMENTS

Hereinafter, a preferred embodiment of a thermal printer according to the invention will be described in detail with reference to the accompanying drawings.

Figure 1:
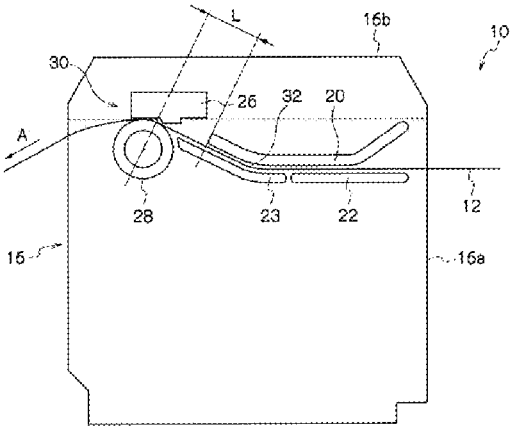
FIG. 1 is a schematic side view of the configuration of a thermal printer according to an embodiment of the invention.

FIG. 1 is a schematic side view of the configuration of a thermal printer 10 according to the invention. The thermal printer 10 prints and issues predetermined information on a surface of a sheet 12.

The thermal printer 10 according to the invention includes an upper guide plate 20 which over lies at least the lateral edges of the sheet 12 as the sheet moves, a lower guide plate 22, which is disposed below at least the lateral edges of the sheet, a fixed guide portion 23, a thermal head 26, and a platen roller 28. The fixed guide portion 23 is provided in a printer lower portion 16*a* and extends to the vicinity of the platen roller 28 so as to guide the lower side of the entire width of the sheet.

As illustrated in FIG. 1, it is preferable that the fixed guide portion 23 comprises a horizontal surface leading into an inclined surface, and it is preferable that the horizontal surface of the fixed guide portion and the upper surface of the sheet lower guide plate 22 be formed in the same or substantially the same plane to avoid bending of the sheet at a transition between the plate 22 and the portion 23.

The sheet 12 is guided by sheet guides which are comprised of the upper guide plate 20, the lower guide plate 22, and the fixed guide portion 23, and is fed to a printing unit 30 which is comprised of the thermal head 26 and the platen roller 28. The rotating shaft of the platen roller 28 is connected to the driving shaft of a motor which is rotatable normally and reversely, via a gear 34 (see FIG. 2). When the driving shaft is rotated, the rotational force thereof is transmitted to the platen roller 28 via the gear, and the sheet 12 is transported by the roller 28 in the arrow A direction (from the upstream side to the downstream side in the transport direction) in FIG. 2.

A printer body 16 of the thermal printer 10 is generally comprised of a printer lower portion 16*a* and a printer upper portion 16*b*. The printer upper portion 16*b* can be opened and closed. The upper guide plate 20, the lower guide plate 22, the fixed guide portion 23, and the platen roller 28 are provided in the printer lower portion 16*a*, and the thermal head 26 is provided in the printer upper portion 16*b*.

The printing unit 30 is formed by the thermal head 26 and the platen roller 28 which are arranged to oppose each other with a sheet transport path 32 interposed therebetween.

The thermal head 26 is a so-called line thermal head in which a number of heating elements (not illustrated) are formed to be lined up on a substrate (not illustrated), and is provided in such a manner that the lined-up direction of the heating elements are perpendicular to the sheet transport direction. Onto the surface of the substrate which is the opposite side to the surface where the heating elements are formed, a heat sink is attached which is formed of metal to have conductivity. The thermal head 26 includes a connector (not illustrated) for a power source and a printing signal, and to the connector, a wiring connector (not illustrated) from the printer body 16 is connected.

Figure 2:
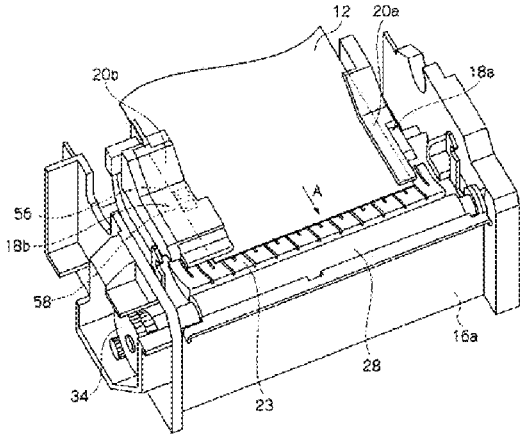
FIG. 2 is a perspective view of the thermal printer according to the embodiment of the invention.
Figure 3:
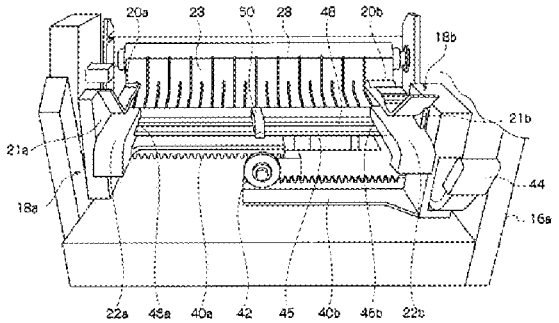
FIG. 3 is a schematic rear view of the thermal printer according to the embodiment of the invention.
Figure 4:
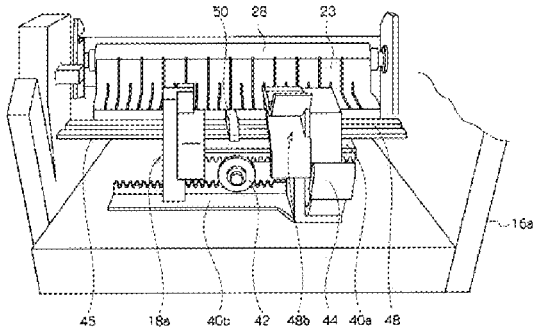
FIG. 4 is a schematic rear view of the thermal printer according to the embodiment of the invention in a first condition.

FIG. 2 illustrates the printer lower portion 16*a* excluding the printer upper portion 16*b* from the thermal printer 10. FIGS. 3 and 4 illustrate the printer lower portion 16*a* of FIG. 2 viewed from the rear. In addition, the sheet 12 is not illustrated in FIGS. 3 and 4.

The upper guide plate 20 and the lower guide plate 22 described above are provided in a pair of sheet guides 18*a* and 18*b* as illustrated in FIG. 3 in the thermal printer 10.

The sheet guides 18*a* and 18*b* are comprised of upper guide plates 20*a* and 20*b* which guide the upper side of the sheet, lower guide plates 22*a* and 22*b* which guide the lower side of the sheet, and width guide plates 21*a* and 21*b* which guide the width of the sheet using the pair of sheet guides 18*a* and 18*b*. The pair of sheet guides 18*a* and 18*b* are provided in the vicinity of the fixed guide portion 23.

The pair of sheet guides 18*a* and 18*b*, that is, the upper guide plates 20*a* and 20*b*, the width guide plates 21*a* and 21*b*, and the lower guide plates 22*a* and 22*b* form a part of the sheet transport path 32.

In the sheet guide 18*b*, a reflection type sensor 56 and a transmission type sensor 58 are sequentially arranged along the sheet transport direction (FIG. 2).

The reflection type sensor 56 detects a mark (not illustrated) formed on the rear surface side of the sheet 12 to use the mark as a reference position for a start of printing on the basis of the detected data. The reflection type sensor 56 can detect marks (not illustrated) which are mainly formed on a continuous sheet at predetermined intervals.

The transmission type sensor 58 can detect a leading edge of the sheet 12 which is inserted from the rear surface side of the sheet 12. The platen roller can be driven by detecting the leading edge of the sheet. The transmission type sensor 58 mainly detects the leading edge of a single sheet 12.

As described above, since the reflection type sensor 56 and the transmission type sensor 58 are sequentially arranged along the sheet transport direction, the width (length in the sheet width direction) of the upper guide plate 20*b* can be reduced, and thus the quality of the printing surface side of the sheet is not degraded.

In the thermal printer 10 of this embodiment, the sheet guides 18*a* and 18*b* are held to be movable in the width direction of the sheet 12 by a rack and pinion mechanism comprised of racks 40*a* and 40*b* and a pinion 42. The racks 40*a* and 40*b* are respectively mounted on the sheet guides 18*a* and 18*b*. The racks 40*a* and 40*b* are engaged with the pinion 42 so that the racks move in opposite directions.

In FIG. 1, the fixed guide portion 23 is fixed to the printer body 16 while the upper guide plates 20 (20*a* and 20*b*) and the lower guide plates 22 (22*a* and 22*b*) can be moved in the sheet width direction by the sheet guides 18*a* and 18*b*.

In the thermal printer 10 of this embodiment, the rack and pinion mechanism comprised of the racks 40*a* and 40*b* and the pinion 42 is vertically provided with respect to the bottom surface of the printer lower portion 16*a* of the printer body. Accordingly, the length of the thermal printer in the sheet transport direction can be reduced, resulting in a reduction in size.

In order to guide the sheet guides 18*a* and 18*b*, a sheet width direction guide member 45, which guides the bottom surfaces of the lower guide plates 22*a* and 22*b*, is provided in the printer lower portion 16*a* of the printer body. In addition, a groove 48 is formed in the sheet width direction in one of the bottom surface of the lower guide plate and the sheet width direction guide member 45, and convex portions 46*a* and 46*b* which are fitted in the groove 48 are formed in the other. FIGS. 3 and 4 illustrate that the groove 48 is formed in the sheet width direction guide member 45 and the convex portions 46*a* and 46*b* are formed in the bottom surfaces of the lower guide plates 22*a* and 22*b*.

In addition, the sheet width direction guide member 45 and the fixed guide portion 23 may be formed integrally with each other. The sheet width direction guide member 45 is provided at a position below the guide surface of the sheet, and the rack and pinion mechanism is disposed below the sheet width direction guide member 45.

Accordingly, a rail mechanism is provided. Thus backlash of the sheet guide, which is caused by the sheet guide's own weight or a force associated with the transportation of the sheet, is prevented, resulting in a reduction in the size of the thermal printer in the scanning direction. In addition, FIG. 3 illustrates an enlarged width between the pair of sheet guides 18*a* and 18*b* is increased, and FIG. 4 illustrates a reduced width between the pair of sheet guides 18*a* and 18*b*. However, the interval between the pair of sheet guides 18*a* and 18*b* can be stably changed in the configuration of the invention without occurrence of backlash of the sheet guide. It is preferable that a fixing mechanism 44 which fixes the width between the pair of sheet guides 18*a* and 18*b* be provided in the thermal printer 10.

As illustrated in FIGS. 3 and 4, it is preferable that a narrow sheet lower side guide member 50 having a predetermined width in the sheet width direction be provided at the center between the pair of opposing sheet guides 18*a* and 18*b*. The height of the upper surface of the sheet lower side guide member 50 may be the same or substantially the same as that of the sheet contact surface of the fixed guide portion 23.

Since the narrow sheet lower side guide member 50 having the predetermined width in the sheet width direction is provided, the sheet lower side guide member receives a part of the force associated with the transportation of the sheet, and thus a burden of the force on the sheet guides is reduced. Therefore, the backlash of the sheet guide can be further prevented.

Figure 5:
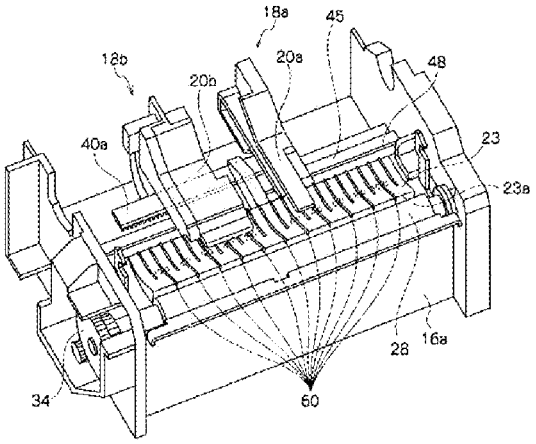
FIG. 5 is a perspective view of the thermal printer according to the embodiment of the invention in a second condition.

In FIG. 5, a scale (ribs) 60 for checking the sheet width is formed in the fixed guide portion 23, which extends to the vicinity of the platen roller 28, to guide the lower side of the entire width of the sheet. The upper guide plates 20*a* and 20*b* of the pair of sheet guides 18*a* and 18*b* are formed to reach the position of the upper portion of the fixed guide portion 23.

The sheet 12 is guided by the fixed guide portion 23 which guides the lower side of the entire width of the sheet to the vicinity of the platen roller 28, and by the upper guide plates 20*a* and 20*b* which guide the upper side of the sheet and are formed to reach the upper portion of the fixed guide portion, and the sheet 12 is transported to the platen roller 28. Accordingly, the fluttering of the sheet during printing by the thermal head 26 (see FIG. 1) can be prevented. This prevents printing failure or a sheet jam.

Furthermore, since the upper guide plate is formed to reach the upper portion of the fixed guide portion in which the scale for checking the sheet width is provided, the sheet width can be easily set, and the setting of the sheet width can be accurately performed, which also prevents fluttering of the sheet.

Figure 6:
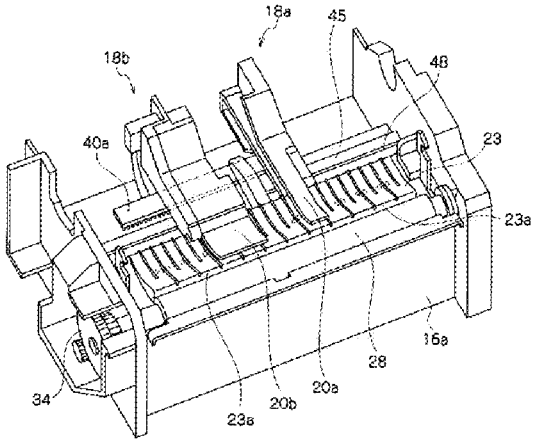
FIG. 6 is a perspective view of the thermal printer according to the embodiment of the invention.

It is preferable that the upper guide plates 20*a* and 20*b* be formed to reach a position of 7 mm from the surface of the platen roller 28 or to reach a position of 20 mm (a position at a distance L of FIG. 1 is the position of 20 mm) from the axial center of the platen roller 28. Particularly, as illustrated in FIG. 6, it is preferable that the upper guide plates 20*a* and 20*b* be formed to reach the position of a leading edge 23*a* of the fixed guide portion.

Since the upper guide plates are preferably formed to reach the position of 7 mm from the surface of the platen roller 28 or to the position of 20 mm from the shaft center of the platen roller 28, more preferably the position of the leading edge 23*a* of the fixed guide portion, the sheet can be vertically guided immediately before being printed by the thermal head. Therefore, the fluttering of the sheet can be further prevented, and thus printing failure or a sheet jam can be prevented. In addition, since the length of the upper guide plate which covers the upper portion of the scale of the fixed guide portion is increased, the scale for checking the sheet width is easily checked.

Figure 7:
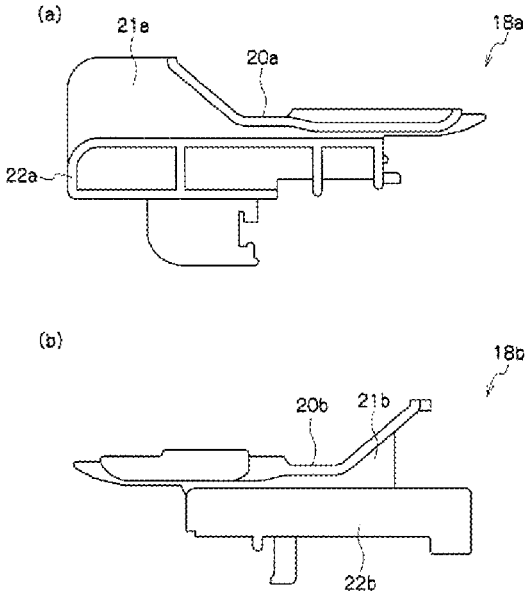
FIGS. 7(*a*) and 7(*b*) are side views of sheet guides according to the embodiment of the invention.

As illustrated in FIGS. 7(*a*) and 7(*b*), it is preferable that the leading edge portions of the upper guide plates 20*a* and 20*b* on the platen roller side have R shapes. FIG. 7(*a*) is a side view illustrating the upper guide plate 20*a*, and FIG. 7(*b*) is a side view illustrating the upper guide plate 20*b*.

As illustrated in FIGS. 7(*a*) and 7(*b*), since the leading edge portion of the upper guide plate has an R shape in which the sheet transport path widens toward the downstream side, the sheet can be transported to the platen roller without scratches.

The configuration of the thermal printer described above in the embodiment is not limited to the above-described embodiment.

In this embodiment, the thermal printer is exemplified so that the sheet is fed from the outside of the thermal printer. However, the application of the invention is not limited thereto. For example, as a matter of course, a sheet roll may be supported by a thermal printer body.

Figure 8:
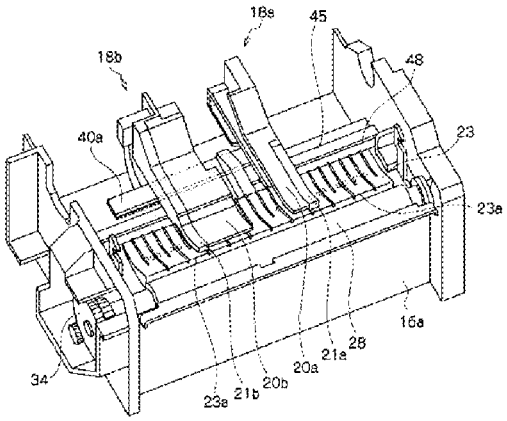
FIG. 8 is a perspective view of the thermal printer according to the embodiment of the invention.

In addition, in this embodiment, the upper guide plates 20*a* and 20*b* are formed to be positioned to reach the vicinity of the leading edge 23*a* of the fixed guide portion. However, as illustrated in FIGS. 7(*a*) and 7(*b*) or FIG. 8, the width guide plates 21*a* and 21*b* may be formed to be positioned to reach the vicinity of the leading edge 23*a* of the fixed guide portion. Since the pair of width guide plates 21*a* and 21*b* extends to a position that reaches the fixed guide portion 23, skewing of the leading edge portion of the sheet during the setting of the sheet can be suppressed.

The width guide plates 21*a* and 21*b* of the sheet guides 18*a* and 18*b* may be formed to reach the upper portion of the fixed guide portion 23, and may extend to the platen roller 28 further from the upper guide plates 20*a* and 20*b* (FIGS. 7(*a*) and 7(*b*)). With this configuration, in a case where the sheet is reversely transported from the printing unit side to the rear surface side (sheet supply side), the skewing of the sheet can be suppressed.

REFERENCE SIGNS LIST

10 thermal printer
12 sheet
16 printer body
16*a* printer lower portion
16*b* printer upper portion
18*a*, 18*b* sheet guide
20 upper guide plate
21*a*, 21*b* width guide plate
22, 22*a*, 22*b* lower guide plate
23 fixed guide portion
26 thermal head
28 platen roller
30 printing unit
32 sheet transport path
40*a*, 40*b* rack
42 pinion
44 fixing mechanism
45 sheet width direction guide member
46*a*, 46*b* convex portion
48 groove
50 sheet lower side guide member
56 reflection type sensor
58 transmission type sensor
60 scale (rib)

The invention claimed is:

1. A thermal printer comprising:

a rotatable platen roller;

a thermal head disposed in opposition to the platen roller and configured to cause printing of sheet passing by;

a fixed guide portion positioned at an upstream side of the platen roller with respect to a sheet moving through the printer, the fixed guide portion is configured to guide a lower side of an entire width of a sheet to be printed; and a pair of opposing sheet guides on an upstream side of the each sheet fixed guide portion, comprising a width guide plate that guides a respective side of the sheet for sheet a width dimension, a lower guide plate located below and configured to guide a lower side of the sheet, and an upper guide plate located above and configured to guide an upper side of the sheet, and the sheet guides are movable in a sheet width direction; and wherein the upper guide plate is shaped and located to reach an upper portion of the fixed guide portion.

2. The thermal printer according to claim 1, wherein the upper guide plate is shaped and located to reach a position of a leading edge of the fixed guide portion.

3. The thermal printer according to claim 1, wherein the width guide plate is shaped and located to reach the upper portion of the fixed guide portion, and extends to a platen roller side further from the upper guide plate.

4. The thermal printer according to claim 1, wherein the upper guide plate has a leading edge portion on the platen roller side and the upper guide plate has an R shape.

* * * * *